United States Patent [19]

Herman

[11] 4,296,497

[45] Oct. 27, 1981

[54] HOSPITAL PATIENT GOWN

[75] Inventor: Seymour S. Herman, New York, N.Y.

[73] Assignee: Stan Herman Studio, Inc., New York, N.Y.

[21] Appl. No.: 150,324

[22] Filed: May 16, 1980

[51] Int. Cl.[3] ..... A41B 9/00
[52] U.S. Cl. ..... 2/114
[58] Field of Search ..... 2/114, DIG. 7, 74, 69, 2/109

[56] References Cited

U.S. PATENT DOCUMENTS

| | | | |
|---|---|---|---|
| 3,155,984 | 11/1964 | Derrick | 2/DIG. 7 |
| 3,720,957 | 3/1973 | Patience | 2/DIG. 7 |
| 3,977,025 | 8/1976 | Horan | 2/51 |
| 4,106,120 | 8/1978 | Zurbrigg | 2/51 |

*Primary Examiner*—Doris L. Troutman
*Attorney, Agent, or Firm*—Albert F. Kronman

[57] ABSTRACT

A hospital patient gown in which a front panel is joined to two rear panels to form a garment having an elongated vertical opening at the back. One of the rear panels is vertically pleated with a reverse pleat and draped across the rear opening when the rear panels are fastened together at the top of the gown.

5 Claims, 4 Drawing Figures

HOSPITAL PATIENT GOWN

BACKGROUND OF THE INVENTION

Hospital patient gowns, as a result of the requirements of their use, must be relatively simple in construction, capable of repeated washing, simple to place upon a patient under hospital conditions and of a single piece. Such garments are usually provided with a back opening fastened with strings, snaps, hooks or the like. Such fasteners are difficult for the patient to manage and often cause discomfort when the wearer is lying upon his back.

Accordingly, it is an object of the present invention to provide a hospital patient gown which will avoid the disadvantages of prior known gowns.

Another object of the present invention is to provide a hospital patient gown which does not require fastening devices spaced longitudinally along the back thereof to remain in a closed condition.

Still another object of the present invention is to provide a hospital patient gown of simple construction which will withstand repeated washing and wearing cycles.

SUMMARY

A hospital patient gown according to the present invention consists of a front panel and two rear panels secured together along their adjacent longitudinal and top edges to form a garment having a single longitudinal back opening and an opening for the patient's neck. One of the rear panels is provided with an inverted pleat secured at the top of the garment, which pleated portion extends the length of the rear opening and underlies the free edge of the opposed rear panel thereby providing a fastener free closure. Sleeves of any suitable length are attached to the body of the gown and one or more fasteners at the neck receiving opening hold the garment rear panels together at the top of the said gown.

BRIEF DESCRIPTION OF THE DRAWINGS

In the accompanying drawing forming part hereof, similar parts have been given the same reference numerals, in which drawing.

DETAILED DESCRIPTION

Figure 1:
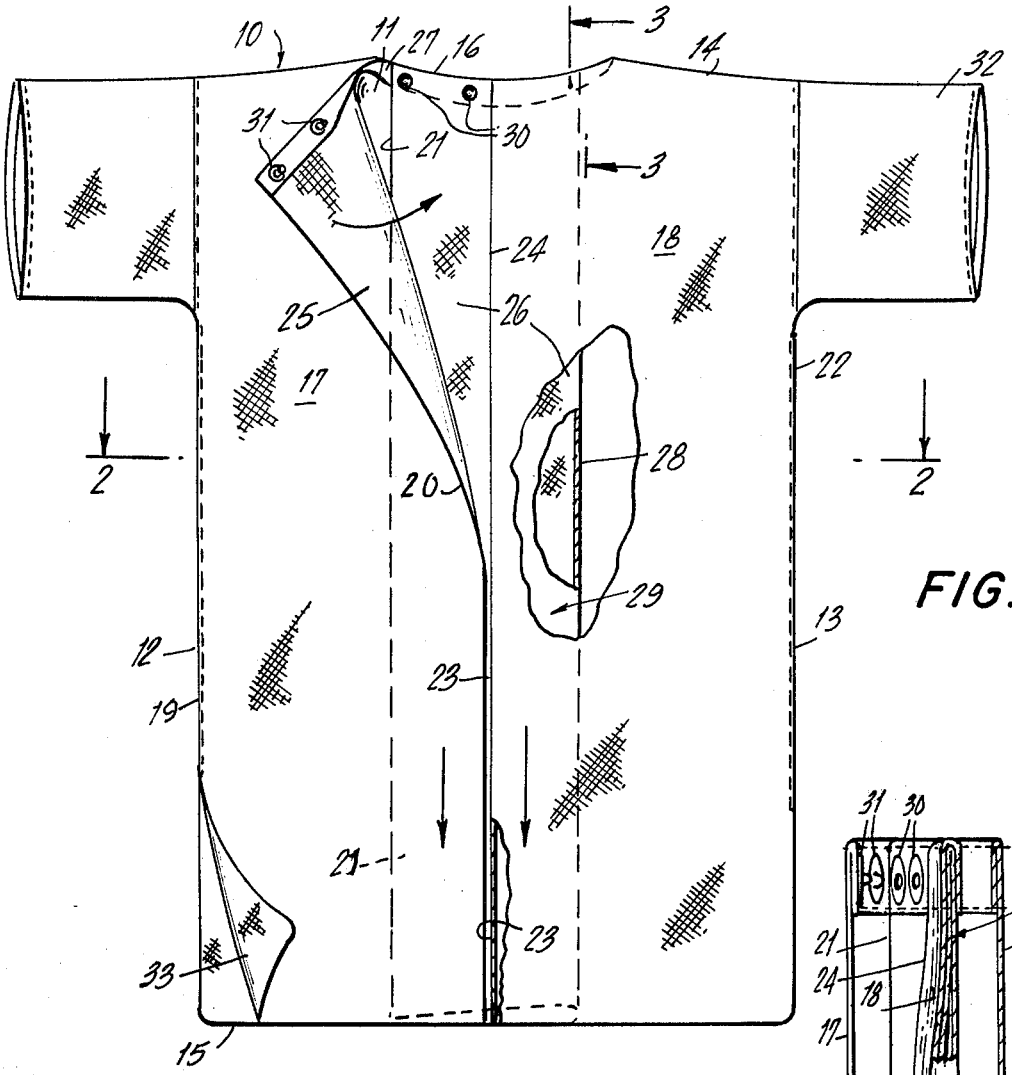
FIG. 1 is a view in rear elevation of a complete embodiment of the present invention with certain portions cut away for the purpose of clarity.
Figure 3:
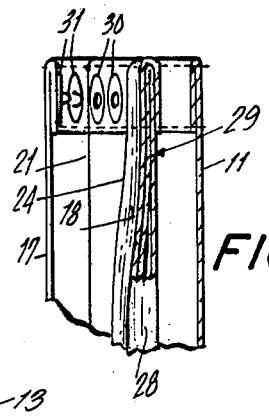
FIG. 3 is a fragmentary longitudinal section taken on line 3—3 in FIG. 1 looking in the direction of the arrows.

Referring to the drawing, 10 indicates a hospital patient gown made of a suitable fabric or sheet material such as woven or unwoven natural or synthetic fibers or sheets. A single, preferably unitary, front panel 11 of fabric is cut in the wellknown manner to cover the front portion and limbs of the patient.

The front panel 11 is substantially rectangular in shape and has elongated side margins 12, 13, a top or shoulder edge 14 and a bottom or hem edge 15. The shoulder edge 14 may be contoured as indicated at 16 in FIG. 1 to conform to the neck of the wearer.

A first and a second rear panel 17, 18, made of any suitable fabric or sheet material and of substantially elongated rectangular shape are secured, as by sewing or bonding to the front panel 11. Each of the rear panels have elongated side margins 19, 20, 21, 22. The rear panels 17, 18, are secured to front panel 11 along their side margins 19, 22 to substantially overlie the said front panel leaving the free margins 20, 21, to define a rear opening 23 therebetween.

Figure 2:
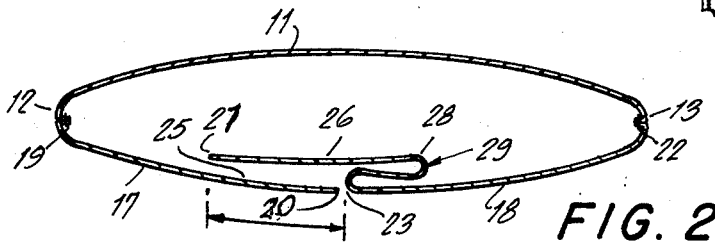
FIG. 2 is a cross sectional view taken on line 2—2 in FIG. 1 looking in the direction of the arrows.
Figure 4:
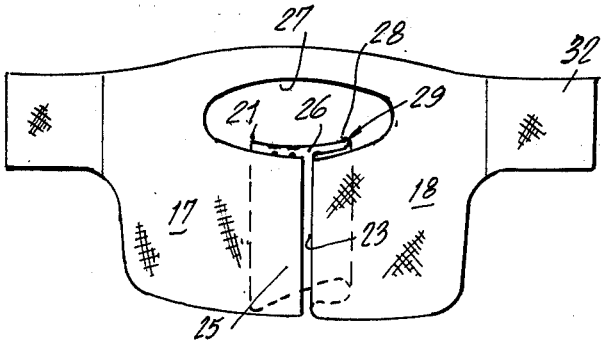
FIG. 4 is a somewhat isometric top view on a reduced scale of the garment of FIG. 1.

While the free margin 20 of the first rear panel 17 lies along the longitudinal axis 24 of the gown, it will be seen from FIGS. 1, 2 and 4 that the free margin 21 of the second rear panel 18 extends beyond the longitudinal axis 24 so as to underlie a portion of the first rear panel. The rear panels 17, 18 are not secured together at their free portions 25, 26, except in the area of a neck band 27 at the top of the gown. Despite the lack of fastening means the rear opening 23 remains covered by the free portion of rear panel 18. This closure is achieved by a pleat and drape structure of the second rear panel 18.

As shown at 28 in FIGS. 1, 2 and 4 the free portion 26 of the second rear panel 18 is doubled back upon itself to form an inverted pleat 29. The pleat 29 is tacked to the neck band portion 27 at the back of the gown and extends freely beyond the said neck band portion past the longitudinal axis 24. The free portion 26 at its top is provided with snaps 30 or other securing means to cooperatively engage securing means 31 on the free portion 25 of the first rear panel 17. The snaps 30, 31, are located inwardly of the longitudinal margins 20, 21, so that the pleated portion of the rear panel 18 is draped across the rear opening 23 at all times while the gown is being worn.

It will be apparent to those skilled in the art that sleeves 32 such as are shown in FIGS. 1 and 4 of any desirable length and shirt tails 33 shown in FIG. 1 may be added to the garment without departing from the spirit of the invention.

Having thus fully disclosed the invention, what is claimed and desired to be protected by Letters Patent is:

1. A hospital patient gown comprising a front panel, a first and a second rear panel, longitudinal side margins on each of the said panels, means to secure the front panel and side panels together to form a gown having an elongated vertical rear opening therein, a neck band on said panels, a free portion on the first and the second rear panel, an inverted pleat on one of said free portions said pleated portion extending across the rear opening and underlying the other free portion and means carried by the neck band and pleated portion to secure the rear panels together.

2. A gown according to claim 1 in which the front panel, the first rear panel and the second rear panel are of elongated substantially rectangular shape having elongated side margins and the rear panels are secured to opposite side margins of the front panel with the free ends of the rear margins defining the rear opening of the gown.

3. A gown according to claim 1 in which the inverted pleat is formed by doubling the free portion of one of the rear panels back upon itself and securing at least a part of said double back portion to the neck band on the said rear panel.

4. A gown according to claim 3 in which the free portion is draped across the elongated rear opening of the gown.

5. A gown according to claim 1 in which the panel securing means are disposed inwardly of the elongated margins on the free portions.

* * * * *